US005449103A

United States Patent [19]

Tilley

[11] Patent Number: 5,449,103

[45] Date of Patent: Sep. 12, 1995

[54] SECURITY HOLSTER

[76] Inventor: Michael A. Tilley, 7987 S. 13th E., Muskogee, Okla. 74403

[21] Appl. No.: 331,412

[22] Filed: Oct. 31, 1994

[51] Int. Cl.[6] ..... F41C 33/02

[52] U.S. Cl. ..... 224/244; 224/245; 224/911; 224/912

[58] Field of Search ..... 224/191–193, 224/198, 206, 238, 242–245, 253, 911–913

[56] References Cited

U.S. PATENT DOCUMENTS

| | | | |
|---|---|---|---|
| 1,750,139 | 3/1930 | Swift | 224/244 |
| 2,551,913 | 5/1951 | Toby | 224/244 |
| 3,419,728 | 12/1968 | Wilson | 224/912 |
| 3,866,811 | 2/1975 | Hamby | 224/244 |
| 3,910,469 | 10/1975 | Baldochhi | 224/243 |
| 4,340,437 | 7/1982 | Rogers | 156/224 |
| 4,934,574 | 6/1990 | Salandre | 224/244 |
| 5,275,317 | 1/1994 | Rogers et al. | 224/244 |
| 5,395,021 | 3/1995 | Brown | 224/244 |

*Primary Examiner*—Henry J. Recla
*Assistant Examiner*—Peter S. Hrycko
*Attorney, Agent, or Firm*—Dunlap & Codding

[57] ABSTRACT

An improved security holster comprising a solenoid having a plunger member positionable in a locked gun position wherein the plunger member extends through the trigger guard of the gun when the gun is disposed in a pocket defined by a holster body and positionable in an unlocked gun position wherein the plunger member is retracted from the trigger guard of the gun. The solenoid is connected to a power source and a magnetic reed switch is interposed between the solenoid and the power source to allow electrical continuity to be established between the power source and the solenoid by placing a magnet, located on an individual's hand, near the switch. In an energized condition, the solenoid positions the plunger member in the unlocked position and in a non-energized condition the plunger member is biased in the locked gun position.

7 Claims, 4 Drawing Sheets

SECURITY HOLSTER

BACKGROUND OF THE INVENTION

1. Field of the Invention

The present invention relates generally to holsters for firearms, and more particularly, but not by way of limitation, to an improved security holster having a plunger which is extendable through the trigger guard of the handgun for securing the handgun in the holster and magnetically retractable from the trigger guard to allow the handgun to be drawn from the holster.

2. Description of Related Art

Law enforcement officers must often apprehend suspects without their sidearm drawn. In these situations, officers are trained to guard their holstered gun from unauthorized access. Nevertheless, occurrences of apprehended suspects gaining access to an officer's gun and using it to injure or kill the officer or an innocent bystander are continually reported.

Various devices have been employed to secure the gun in the holster and prevent unauthorized access, such as cover flaps, restraining straps, spring mechanisms, and custom molded holsters. While these devices have generally been effective in detouring unauthorized access of officers' guns, skilled and experienced persons can quickly manipulate these devices and remove an officer's gun from his or her holster.

Therefore, an improved security holster is needed which allows an individual wearing the holster to quickly and easily draw the gun from the holster, while at the same time prevent unauthorized access to the gun. It is to such an improved security holster that the present invention is directed.

DETAILED DESCRIPTION

Figure 1:
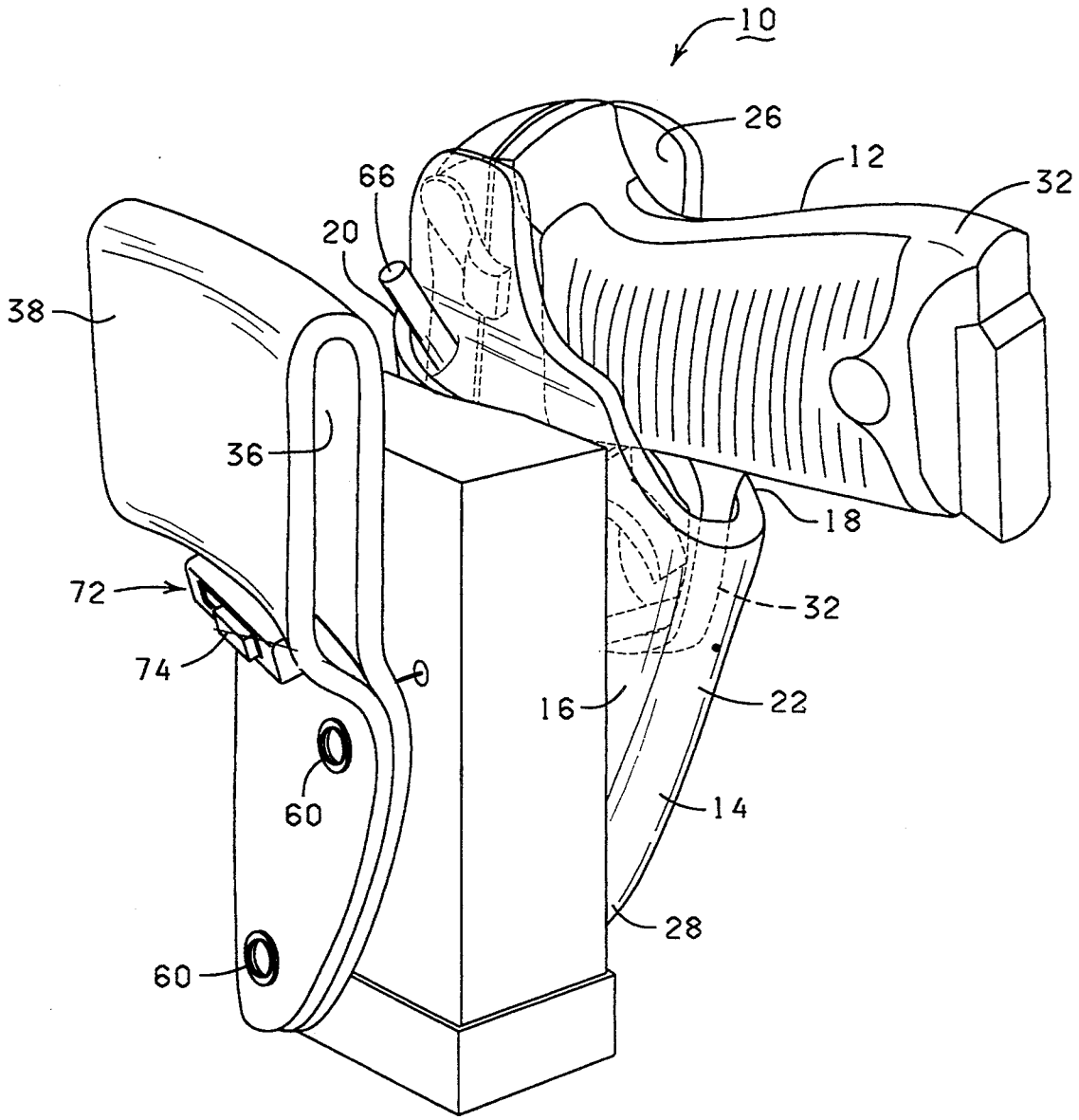
FIG. 1 is perspective view of a security holster constructed in accordance with the present invention showing a gun secured therein.
Figure 2:
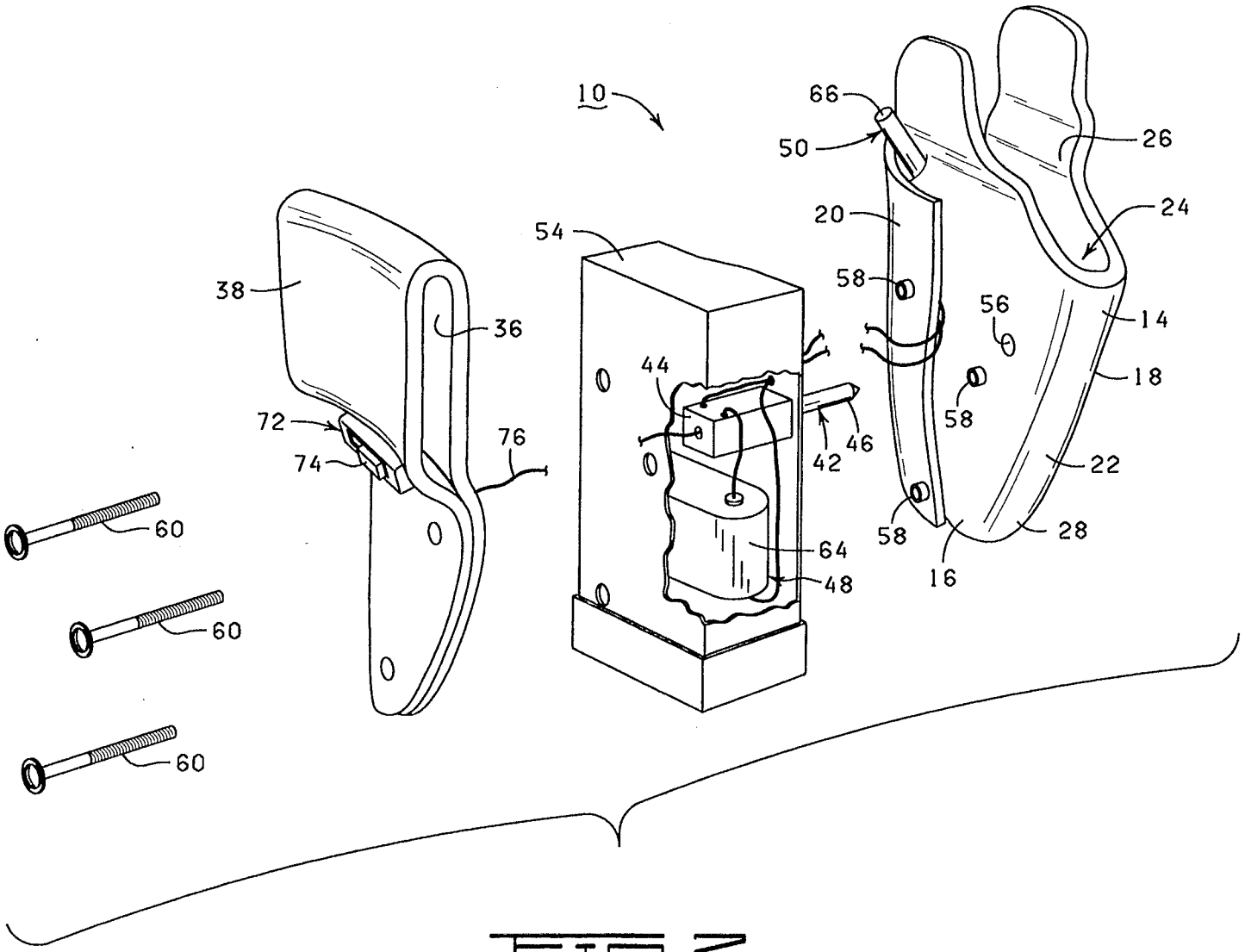
FIG. 2 is an exploded view of the security holster of FIG. 1 without the gun.

Referring now to the drawings, and more particularly to FIGS. 1 and 2, shown is a security holster 10 constructed in accordance with the present invention with a handgun 12 disposed therein. The security holster 10 includes a holster body 14 characterized has having an inner wall 16, an outer wall 18, a front wall 20 and a rear wall 22, which together cooperate to define a pocket 24, (FIG.2) for holding the handgun 12. The holster body 14 is typically molded or shaped so that the gun 12 fits snugly in the pocket 24 formed by the walls 16–22, as illustrated in FIG. 1. The walls 16–22 further cooperate to define an open top portion 26 and a bottom portion 28.

The gun 12 is inserted into the holster body 14 through the open top portion 26 such that a barrel (not shown) of the gun 12 is disposed substantially adjacent the bottom portion 28 of the holster body 14 and a handle 32 of the gun 12 extends upwardly from the open top portion 26. With the gun 12 disposed in the holster body 14, a trigger guard 34 of the gun 12 abuts the rear wall 22 near the open top portion 26 of the holster body 14.

The holster body 14 is attachable to a belt or shoulder harness via a belt receiving loop incorporated into the holster body 14 or a belt receiving loop 36 formed in a backing plate 38 as shown herein. The backing plate 38 is typically secured to the inner wall of the holster body with a plurality of screws.

Holster bodies as briefly described above are manufactured in various shapes and sizes to accommodate different types of guns. Furthermore, holster bodies, as well as the components comprising such devices are well known in the art. Thus no further description of the their components or their operation is believed necessary in order to enable one skilled in the art to understand the security holster 10 of the present invention.

To lock the gull 12 in the holster body 14 when the gun is not in use, the security holster 10 of the present invention is provided with a magnetic gun lock mechanism 42. Referring now to FIGS. 2–5, the gun lock mechanism includes a solenoid 44 having a reciprocating plunger or retaining member 46 which is extendable through the trigger guard 34 of the gun 12 so as to secure the gun 12 in the holster body 14. The gun lock mechanism further includes a power source 48 electrically connected to the solenoid 44 and a switch 50 interposed between the solenoid 44 and the power source 48 which allows the solenoid 44 to be selectively energized to retract the plunger member 46 from the trigger guard 34 when an authorized individual desires to withdraw the gun 12 from the holster body 14.

Figure 3:
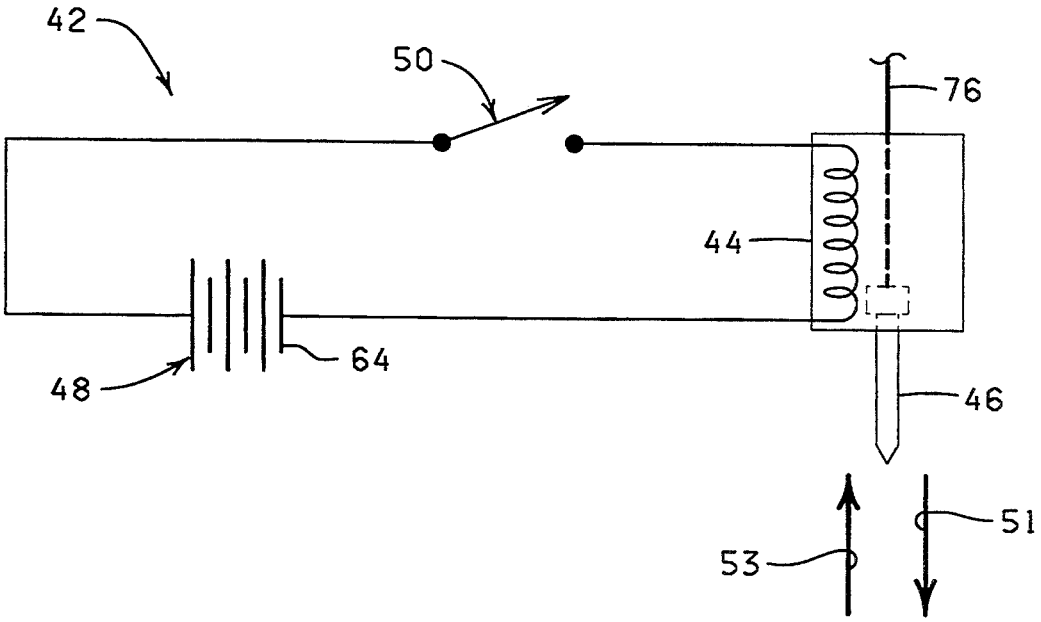
FIG. 3 is a circuit diagram for a gun locking mechanism.
Figure 4:
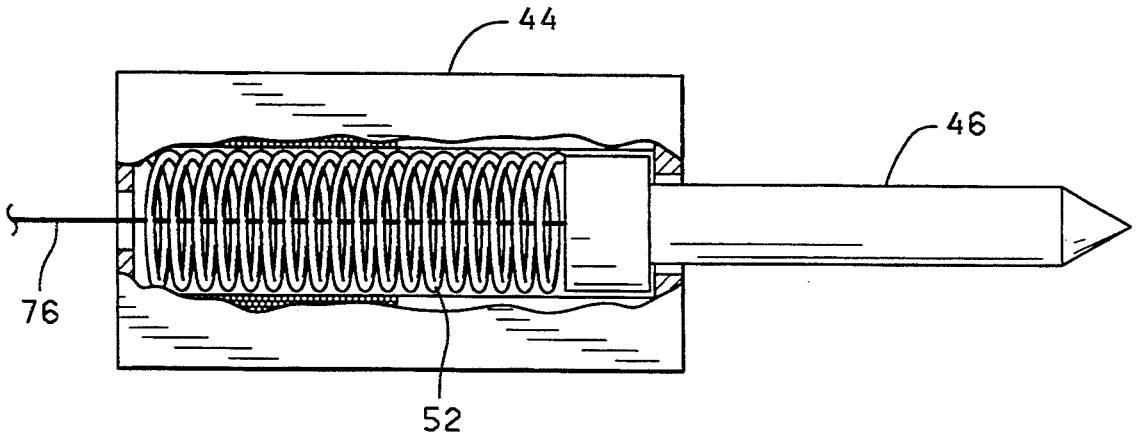
FIG. 4 is a partial cutaway, side elevational view of a solenoid illustrating the plunger member biased in an extended in a gun locked position by a coil spring.
Figure 5:
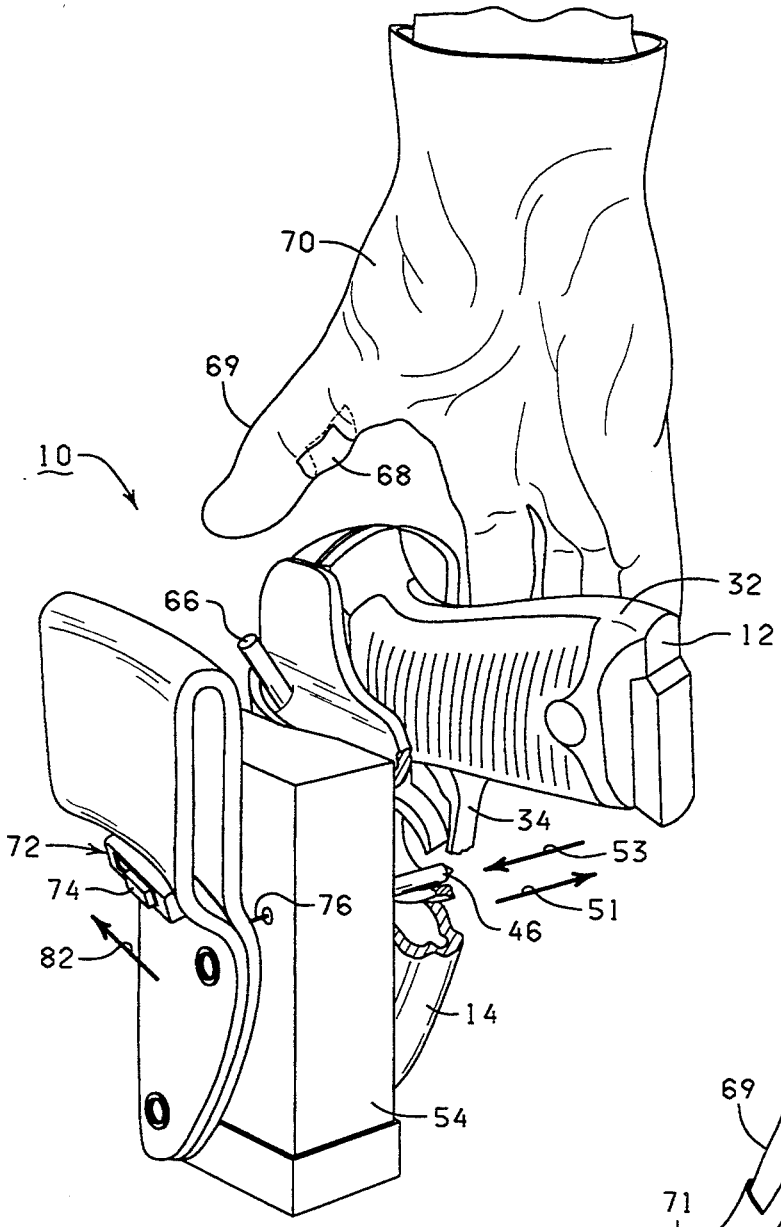
FIG. 5 is a perspective view of the security holster of the present invention illustrating the gun being withdrawn from the security holster by an individual wearing a glove having a magnet incorporated therein.

The plunger member 46 is extendable from the solenoid when the solenoid is in a non-energized condition (as represented by arrow 51 in FIGS. 3 and 5) and drawn into the solenoid when the solenoid 44 is in an energized condition (as represented by arrow 53 in FIGS. 3 and 5). As illustrated in FIG. 4 the plunger member 46 is extended by a coil spring 52 disposed between the plunger member 46 and the solenoid 44 such that the plunger member 46 is extended from the solenoid 44 when the solenoid 44 is non-energized.

The solenoid 44 can be any solenoid suitable for drawing the plunger member 46 from the trigger guard 34 in a quick and dependable manner, such as a commercially available pull type 6.0 vdc solenoid. The solenoid 44 is mounted to the inner wall 16 of the holster body 14 adjacent to the portion of the holster body 14 where the trigger guard 34 rests in the holster body 14 such that the plunger member 46 is positionable in a locked gun position wherein the plunger member 46 extends into the pocket 24 of the holster body 14 and through the trigger guard 34 of the gun 12 when the gun 12 is disposed in the pocket 24 of the holster body 14. Conversely, the plunger member 46 is positionable in an unlocked gun position wherein the plunger member 46 is retracted from the trigger guard 34 of the gun 12 when the gun 12 is disposed in the pocket 24 of the holster body 14. The solenoid 44 can be mounted to the holster body 14 in any suitable fashion, such as screwing, clamping, riveting or the like. In one embodiment (not illustrated), the solenoid may be attached to a steel band incorporated into the holster body 14. Alternatively, as shown herein, the security holster 10 is secured within a housing 54 which in turn is attached to the inner wall 16 of the holster body 14.

As shown in FIG. 2 the housing 54 is configured to enclose the solenoid 44, as well as other components of the lock mechanism 42 to be described below. The housing 54 is provided with an aperture (not shown) which permits the plunger member 46 to slidably extend from the housing 54. The solenoid 44 is preferably secured within the housing 54 with screws (not shown) or other suitable device with the plunger member 46 extending outwardly through the aperture (not shown) in the housing 54.

To enable the plunger member 46 to extend into and communicate with the pocket 24 of the holster body 14 so as to enable the plunger member 46 to secure the gun 12 in the holster body 14, the holster body 14 is provided with an aperture 56 formed through the inner wall 16 of the holster body 14. The holster body 14 is further provided with a plurality of threaded bores 58, each being dimensioned to receive an attachment screw 60. The housing 54 is positioned on the holster body 14 between the holster body 14 and the backing plate 38 as shown in FIG. 1 such that the plunger member 46 of the solenoid 44 can slide easily back and forth through the aperture 56 of the holster body 14. The housing 54 and the backing plate 38 are attached to the inner wall 16 of the holster body 14 as show in FIG. 1 with the screws 60.

With the solenoid 44 in a non-energized condition, the plunger member 46 is biased into the pocket 24 of the holster body 14 by the coil spring 52 (FIG. 4) thereby locking the gun 12 in the holster body 14 when the plunger member 46 is disposed through the trigger guard 34. To retract the plunger member 46 from the trigger guard 34 so that the gun 12 can be withdrawn from the holster body 14, the solenoid 44 is energized.

To energize the solenoid 44, the solenoid 44 is electrically connected to the power source 48 as illustrated in FIG. 3. The power source 48 is illustrated as being a battery 64, such as a 7.5 volt, nickel-cadmium rechargeable battery. However, it will be appreciated by those skilled in the art that the power source 48 can be any device which will provide sufficient power to operate the solenoid 44, such as solar panels. The battery 64 can be housed in the housing 54 as illustrated in FIG. 2 or alternatively attached to the waist belt or shoulder harness.

The switch 50 is interposed between the solenoid 44 and the battery 64 to allow the solenoid 44 to be selectively energized as the gun 12 is being withdrawn from the holster body 14 by the authorized individual. More specifically, the switch 50, which is preferably in a normally open position, is positionable in a closed position as an authorized individual is extracting the gun 12 from the holster body 14. With the switch 50 in the closed position, the electrical continuity is established between the battery 64 and the solenoid 44 thereby placing the solenoid 44 in an energized condition and drawing the plunger member 46 in the unlocked position. In the open position of the switch 50, the electrical continuity is interrupted between the power source 48 and the solenoid 44 thereby placing the solenoid 44 in a non-energized condition and causing the plunger member 46 to be biased in the locked gun position.

So that only an authorized individual can energize the solenoid and thus unlock the gun 12, a magnetic reed switch 66 is provided as the switch 50. The magnetic reed switch 66 is actuated by positioning a magnet near the reed switch 66 thereby attracting the contacts (not shown) of the magnetic reed switch 66 together. The magnetic reed switch 66 is mounted on the inner wall 16 of the holster body 14 near the open top portion 26 whereby the authorized individual can actuate the reed switch 66 with a magnet 68 (FIG. 5), preferably equipped on the thumb 69 of the authorized individual, during the act of withdrawing the gun 12 from the holster body 14. As such, it will be recognized that an advantage of the present invention is that no special motions or maneuvers are required by the authorized individual to unlock the gun. That is, the gun 12 is unlocked from the holster body 14 as the authorized individual draws the gun in a conventional manner.

Figure 6:
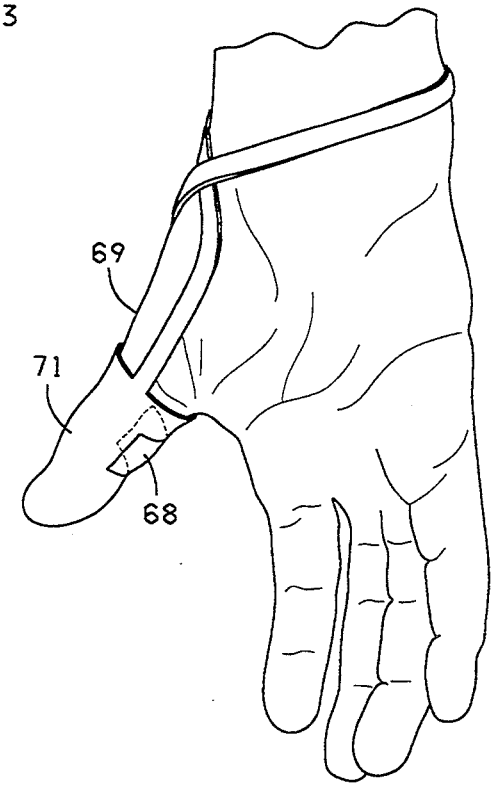
FIG. 6 is a perspective view showing a thumb sleeve having a magnet incorporated therein.

As shown in FIG. 5, the magnet 68 can be incorporated into a glove 70 worn by the authorized individual or incorporated into a lightweight sleeve 71 worn on the thumb of the individual as illustrated in FIG. 6. The reed switch 66 is positioned near the open top portion 26 of the holster body 14 such that when the authorized individual grasps the handle 32 of the gun 12, the magnet 68, located in the glove 70 or the sleeve 71, will be positioned near the reed switch 66, thereby moving the reed switch 66 to the closed position. With the necessity of a magnet to activate the lock mechanism 42, an attacker or unauthorized individual will not be able to unlock the lock mechanism 42 and withdraw the gun 12 from the holster body 14 unless the individual is carrying a magnet and is able to place it near the reed switch 66.

With the gun 12 drawn from the holster body 14, the solenoid 44 is in a non-energized condition and thus the plunger member 46 is biased into the pocket 24 of the holster body 14. To retract the plunger member 46 so that the gun 12 can be inserted into the holster body 14, the reed switch 66 is activated when the magnet 68 is placed near the reed switch 66 as the gun 12 is inserted into the holster body 14. Once the gun 12 is seated into the holster body 14, the magnet 68 is moved a distance away from the reed switch 66 thus causing the solenoid 44 to be de-energized and causing the plunger member 46 to be biased through the trigger guard 34 of the gun 12 so as to secure the gun 12 in the holster body 14.

To enable the gun 12 to be drawn from the holster body 14 in a situation where power to the solenoid 44 is interrupted as a result of failure of the power source 48 or structural damage, such as a broken wire, the security holster 10 is provided with a mechanical release 72 which serves to retract the plunger member 46 from the trigger guard 34 so that the gun 12 can be removed from the holster body 14. The mechanical release 72 includes a sliding switch 74 and a connecting line 76.

The switch is mounted on the inside of the backing plate 38 in such a manner that the mechanical release 72 is hidden from view when the holster body 14 is attached to a belt or shoulder harness and positioned next to the individual's body and therefore not easily accessed by an unauthorized individual. The switch 74 is connected to the plunger member 46 by the connecting line 76. The connecting line 76 can be any suitable device, such as a wire, a chain, or a string, for example, but should be sufficiently flexible so that the connecting line 76 is collapsible. The connecting line 76 has one end connected to the switch 74 and a another end connected to the plunger member 46 (FIG. 4). The connecting line 76 is extended from the switch 74, through the backing plate 38, into the housing 54, and into the solenoid 44 where the end of the connecting line 76 is connected to the plunger member 46. The connecting line 76 has a length which causes the connecting line 76 to be substantially taut when the plunger member 46 is biased into the pocket 24 of the holster body 14, and as stated above, the connecting line 76 should be sufficiently flexible so that the connecting line 76 will collapse so as not to interfere with the normal operation of the plunger member 46 as the plunger member 46 is extended into and withdrawn from the holster body 14 by energizing and de-energizing the solenoid 44 in the manner described above.

The plunger member 46 is manually withdrawn from the holster body 14 with the mechanical release 72 by moving the switch 72 in a direction indicated by arrow 82, thereby causing the plunger member 46 to be pulled from the holster body 14 and into the solenoid 44. The plunger member 46 can be held in the unlocked gun position if desired by providing the switch with a locking device (not shown). While a slidable switch is illustrated herein for actuating the connecting line 76, it will be recognized that any suitable device will actuate the connecting line 76 can be employed, such as a pull ring.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A security holster for carrying a gun having a trigger guard, the holster comprising:

a holster body defining a pocket for holding the gun, the holster body having an upper portion and a lower portion;

a solenoid mounted to the holster body having a plunger member positionable in a locked gun position wherein the plunger member extends through the trigger guard of the gun when the gun is disposed in the pocket of the holster body and in an unlocked gun position wherein the plunger member is retracted from the trigger guard of the gun to allow the gun to be drawn from the holster body;

power means for energizing the solenoid;

a magnetic reed switch interposed between the solenoid and the power means and located proximate the upper portion of the holster body, the magnetic reed switch being positionable in a closed position as an individual draws the gun from the holster body such that electrical continuity is established between the power means and the solenoid thereby placing the solenoid in an energized condition and moving the plunger member to the unlocked position, and the magnetic reed switch being positionable in an open position such that electrical continuity is interrupted between the power means and the solenoid thereby placing the solenoid in a non-energized condition such that the plunger member is positionable in the locked gun position; and a magnet positioned on a hand of the individual wherein the magnet causes the magnetic reed switch to be positioned in the closed position when placed near the magnetic reed switch as the individual is drawing the gun from the holster body and wherein the magnet causes the magnetic reed switch to be positioned in the open position when the magnet is moved a distance away from the magnetic reed switch.

2. The security holster of claim 1 further comprising:

biasing means for biasing the plunger member into the locked gun position when the solenoid is in the non-energized condition.

3. The security holster of claim 2 wherein the biasing means is a coil spring disposed between the solenoid and the plunger member.

4. The security holster of claim 1 wherein the power means is a battery.

5. The security holster of claim 1 further comprising a glove worn by the individual, the glove having the magnet positioned thereon such that the magnet will be positioned near the magnetic reed switch when the individual is drawing the gun from the holster body.

6. The security holster of claim 1 further comprising a sleeve worn by the individual, the sleeve having the magnet positioned thereon such that the magnet will be positioned near the magnetic reed switch when the individual is drawing the gun from the holster body.

7. The security holster of claim 1 further comprising:

a housing secured to the holster body and configured to hold the solenoid and the battery.

* * * * *